US006688409B1

(12) United States Patent
Murray

(10) Patent No.: US 6,688,409 B1
(45) Date of Patent: Feb. 10, 2004

(54) FRICTION REDUCING TOOL AND METHOD FOR ITS USE IN A WELLBORE

(75) Inventor: Geoffrey Neil Murray, Willis, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/889,766

(22) PCT Filed: Jan. 7, 2000

(86) PCT No.: PCT/GB00/00025

§ 371 (c)(1),
(2), (4) Date: Jan. 3, 2002

(87) PCT Pub. No.: WO00/43629

PCT Pub. Date: Jul. 27, 2000

(30) Foreign Application Priority Data

Jan. 22, 1999 (NZ) ..... 333886

(51) Int. Cl.[7] ..... E21B 17/10

(52) U.S. Cl. ..... 175/325.3; 166/241.1; 166/241.6

(58) Field of Search ..... 175/325.3; 166/241.1, 166/241.6, 241.7

(56) References Cited

U.S. PATENT DOCUMENTS

| | | | | |
|---|---|---|---|---|
| 1,651,088 A | | 11/1927 | Fentress | |
| 1,699,087 A | | 1/1929 | Woodmansee et al. | |
| 1,801,294 A | | 4/1931 | Sutton | |
| 1,831,999 A | | 11/1931 | Bull | |
| 1,890,529 A | | 12/1932 | Santiago | |
| 1,893,020 A | | 1/1933 | Cushing | |
| 1,913,365 A | * | 6/1933 | Bailey | 175/325.3 |
| 1,923,328 A | | 8/1933 | Reed | 255/28 |
| 2,601,478 A | | 6/1952 | Weir | 308/6 |
| 2,812,200 A | | 11/1957 | Yeargan | 287/52.09 |
| 2,860,013 A | | 11/1958 | Medearis | 308/4 |
| 2,897,016 A | | 7/1959 | Baker | 308/4 |
| 3,052,310 A | | 9/1962 | Kinzbach | 175/406 |
| 3,054,646 A | | 9/1962 | Minor | 308/4 |
| 3,164,216 A | | 1/1965 | Hall, Sr. et al. | 175/323 |
| 3,669,190 A | | 6/1972 | Sizer et al. | 166/315 |
| 3,797,592 A | | 3/1974 | Goodfellow | 175/325 |
| 3,894,780 A | | 7/1975 | Broussard | 208/4 |
| 4,013,325 A | | 3/1977 | Rear | 308/4 |
| 4,266,578 A | | 5/1981 | Swain et al. | 138/110 |
| 4,273,372 A | | 6/1981 | Sheshtawy | 294/86.15 |
| 4,336,637 A | | 6/1982 | Patterson | 24/249 |
| 4,415,030 A | | 11/1983 | Walkow et al. | 166/241 |
| 4,548,284 A | | 10/1985 | Shinn et al. | 175/346 |
| 4,583,604 A | | 4/1986 | Greer | 175/346 |
| 4,620,802 A | | 11/1986 | Harrel | 384/53 |
| 4,793,412 A | | 12/1988 | Rivas et al. | 166/241 |

(List continued on next page.)

FOREIGN PATENT DOCUMENTS

| | | | |
|---|---|---|---|
| CA | 1044220 | 12/1978 | E21B/17/10 |
| EP | 0 333 450 | 9/1989 | E21B/17/10 |
| GB | 2 233 690 | 1/1991 | E21B/17/10 |
| GB | 2 257 447 | 7/1991 | E21B/17/10 |
| GB | 2 241 009 A | 8/1991 | E21B/17/10 |

(List continued on next page.)

OTHER PUBLICATIONS

Derwent Abstract, Accession No.: 96–127722/13, dated Jul. 9, 1995.

Derwent Abstract, Accession No.: 84–311506/50, dated Apr. 30, 1984.

*Primary Examiner*—David Bagnell
*Assistant Examiner*—Daniel P Stephenson
(74) *Attorney, Agent, or Firm*—Moser, Patterson & Sheridan, L.L.P.

(57) ABSTRACT

A friction reducing tool (1) having a generally tubular body (2) and three or more groups of rotatable castors (3) provided about the periphery of the body, wherein the castors of each group are substantially aligned in a longitudinal direction, and wherein each group of castors has at least one castor offset relative to at least one other castor of the same group.

18 Claims, 4 Drawing Sheets

U.S. PATENT DOCUMENTS

| | | | | | |
|---|---|---|---|---|---|
| 4,796,670 | A | | 1/1989 | Russell et al. | 138/110 |
| 4,811,792 | A | | 3/1989 | Lembcke et al. | 166/381 |
| 4,911,239 | A | | 3/1990 | Winckler et al. | 166/302 |
| 4,913,229 | A | | 4/1990 | Hearn | 166/156 |
| 4,919,205 | A | | 4/1990 | Dollison | 166/241 |
| 4,958,692 | A | * | 9/1990 | Anderson | 175/323 |
| 5,033,558 | A | | 7/1991 | Russo et al. | 175/325 |
| 5,170,847 | A | | 12/1992 | Mims et al. | 166/383 |
| 5,180,010 | A | | 1/1993 | Stout et al. | 166/212 |
| 5,186,264 | A | | 2/1993 | du Chaffaut | 175/27 |
| 5,355,950 | A | * | 10/1994 | Zwart | 166/241.6 |
| 5,409,280 | A | | 4/1995 | Hill | 294/16 |
| 5,522,467 | A | * | 6/1996 | Stevens et al. | 175/73 |
| 5,560,716 | A | | 10/1996 | Tank et al. | 384/492 |
| 5,580,114 | A | | 12/1996 | Palmer | 294/86.15 |
| 5,649,603 | A | | 7/1997 | Simpson et al. | 175/323 |
| 5,692,562 | A | | 12/1997 | Squires | 166/68.5 |
| 5,715,898 | A | * | 2/1998 | Anderson | 175/325.3 |
| 5,778,976 | A | | 7/1998 | Murray | 166/241.6 |
| 5,901,798 | A | | 5/1999 | Herrera et al. | 175/325.3 |
| 6,050,341 | A | | 4/2000 | Metcalf | 166/383 |
| 6,209,667 | B1 | | 4/2001 | Murray et al. | 175/325.3 |
| 6,250,406 | B1 | | 6/2001 | Luke | 175/325.2 |
| 6,382,333 | B1 | | 5/2002 | Murray | 175/325.3 |
| 6,453,999 | B1 | * | 9/2002 | Reinholdt | 166/241.3 |
| 6,494,274 | B1 | | 12/2002 | Murray et al. | 175/325.3 |

FOREIGN PATENT DOCUMENTS

| | | | | |
|---|---|---|---|---|
| RU | 976020 | | 4/1983 | E21B/29/10 |
| RU | 2012769 | | 5/1994 | E21B/17/10 |
| WO | WO 85/05414 | | 12/1985 | F16B/19/10 |
| WO | WO 91/08374 | | 6/1991 | E21B/17/10 |
| WO | WO 93/24728 | | 12/1993 | E21B/17/10 |
| WO | WO 9324728 | A1 * | 12/1993 | E21B/17/10 |
| WO | WO 95/05521 | | 2/1995 | E21B/17/10 |
| WO | WO 95/10685 | | 4/1995 | E21B/17/10 |
| WO | WO 95/11368 | | 4/1995 | E21B/17/10 |
| WO | WO 95/21986 | | 8/1995 | E21B/17/10 |
| WO | WO 9521986 | A1 * | 8/1995 | E21B/17/10 |
| WO | WO 96/09459 | | 3/1996 | E21B/17/10 |
| WO | WO 96/34173 | | 10/1996 | E21B/17/10 |
| WO | WO 97/08425 | | 3/1997 | E21B/23/00 |
| WO | WO 98/07953 | | 2/1998 | E21B/17/10 |
| WO | WO 98/40601 | | 9/1998 | E21B/17/10 |
| WO | WO 99/04132 | | 1/1999 | E21B/17/10 |

* cited by examiner

FRICTION REDUCING TOOL AND METHOD FOR ITS USE IN A WELLBORE

The present invention relates to a friction reducing tool for use in well construction and servicing applications. In particular, the invention relates to a friction reducing tool suitable for use during drilling or casing installation procedures.

During exploration for oil, gas, geothermal activity, water or other naturally occurring substances, bores may be drilled to varying distances and can exceed several kilometres in length. Typically, it will be necessary to drill through layers of different formation, such as impermeable cap rock and permeable sandstone. Once a bore has been drilled it is necessary to isolate one formation from another to avoid problems associated with pressure differentials between the formations. Such isolation, known as zonal isolation, is achieved using casing or liner pipe which is cemented into the well bore. To obtain effective cementation it is necessary to centralise the casing or liner pipe in the well bore so that the cement sheath is of adequate thickness to provide suitable integrity.

Frequently, the length of the well bore is such that centralising tools become significantly worn on their trip to the bottom of the well. In an attempt to obviate this problem, tools have been developed to reduce friction caused by contact with the inside wall of the bore. For example, one known tool has groups of rollers positioned on the periphery of the tool.

It is often desirable to insert casing pipe into a bore where the cross sectional diameter of the bore is only marginally greater than the cross sectional diameter of the casing pipe. For example, casing pipe of 7 inch (18 cm) diameter may be required in a bore of 8.5 inch (22 cm) diameter. A small annular spacing will therefore tolerate only a correspondingly small distance between the contact surface of the rollers and the outer periphery of the friction reducing tool. This requires the use of small rollers which can have limited effectiveness in reducing friction. U.S. Pat. No. 5,778,976 discloses a friction reducing tool having rollers incorporated in radial support pedestals. GB-A-2241009 discloses a friction reducing tool having rollers in the form of discs.

Additionally, rollers of the type used in known friction reducing tools have axles which are limited in respect of cross-sectional diameters. Such axles may be prone to weakness and breakage. A further disadvantage of known roller tools is that cuttings or granular material in the bore can become jammed or wedged between the rollers and the pipe on which the roller tool is mounted.

It is therefore an object of the present invention to provide a friction reducing tool which overcomes the above-mentioned disadvantages, or at least provides a useful alternative.

In one aspect of the invention there is provided a friction reducing tool having a generally tubular body and three or more groups of rotatable castors provided about the periphery of the body, the castors of each group being substantially aligned in a longitudinal direction, and each group of castors having at least one castor offset relative to at least one other castor of the same group, characterised in that each castor is rotatable about an axis extending substantially outwards from the surface of the body.

The at least one castor and the at least one other castor may be positioned on the tubular body so that the axis of rotation of one castor is parallel to the axis of rotation of the other castor and the two axes are diametrically offset relative to an axis parallel to the axis of the tubular body.

Alternatively or additionally, the at least one castor and the at least one other castor may be positioned on the tubular body so that the axis of rotation of one castor and the axis of rotation of the other castor are angled away from each other.

The at least one castor is preferably offset relative to the at least one other castor by an amount sufficient to enable contact of each castor with the inside wall of a bore when in use. Castors having parallel axes of rotation may, for example, be offset by 3–30 mm. Castors having angled axes of rotation may be angled away from each other by an angle of up to 50° or more, but typically closer to 10° to 20°.

Preferably each castor includes a rotatable disc and an axle. The outer surface of the disc is preferably convex in shape.

Preferably the tubular body contains an aperture for receiving an axle of a castor. It is preferred that the axle is fixed to the tubular body within the aperture and that the rotatable disc is free to rotate about the end of the axle protruding from the tubular body.

It is preferred that the three or more groups of castors are located substantially equidistant about the periphery of the tubular body. Preferably, there are five groups of castors.

While there may be any number of castors within one group of castors, preferably there is one or more pairs of complimentary castors offset to each other. In a preferred embodiment of the invention, each group of castors comprises a single pair of castors.

In a second aspect of the invention there is provided a method of using the friction reducing tool of the first aspect including fitting the tool to a pipe and running the pipe through the bore of a well.

In a preferred embodiment of the invention there is provided a friction reducing tool as described above fixed to a tubular section of a casing stand or drill string.

Some preferred embodiments of the invention will now be described by way of example only and with reference to the accompanying drawings in which.

Figure 1:
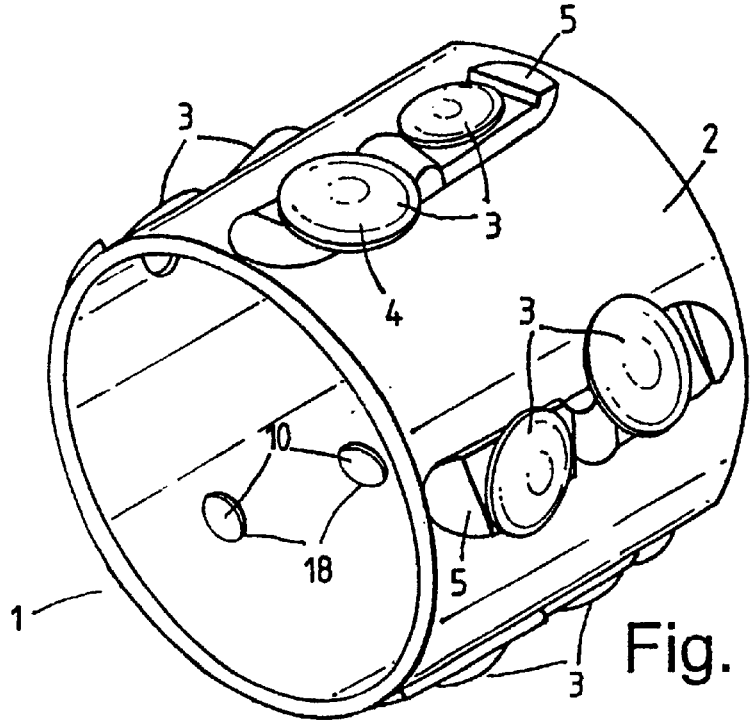
FIG. 1 is a perspective view of a friction reducing tool.

FIG. 1 shows a friction reducing tool 1 having a generally tubular body 2 for receiving a pipe (not shown) and pairs of castors 3. Each castor 3 has a convex shaped disc 4 and each pair of castors 3 is located in a castor housing 5.

Figure 2:
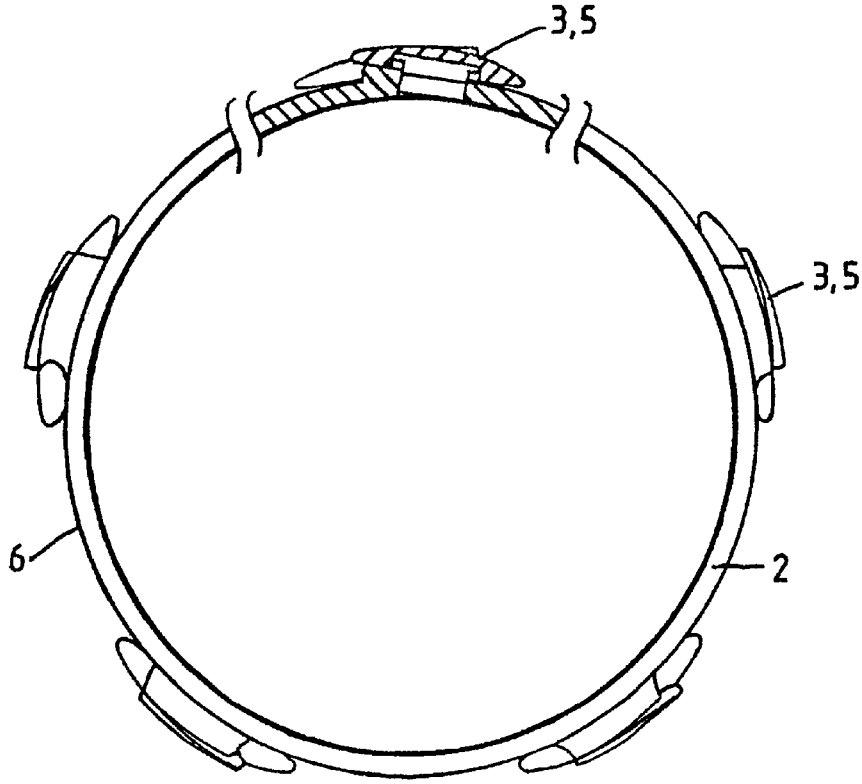
FIG. 2 is an end view of the tool shown in FIG. 1 with a portion shown in cross section.

As can be seen from FIG. 2, five castor housings 5 and pairs of castors 3 are located approximately equidistant around the periphery of the body 2.

The distance between the external surface of casing pipe and the internal surface of a well bore can be small, for example less than 2 cm. It is therefore desirable to minimise the distance between the outer surface 6 of the body 2 and the outer surface of the castors 3.

Although FIG. 2 shows five pairs of castors 3 located on the body 2, it will be appreciated that three groups of castors 3 will be sufficient. Equally, it is envisaged that the body 2 may have more than five groups of castors 3.

Figure 6:
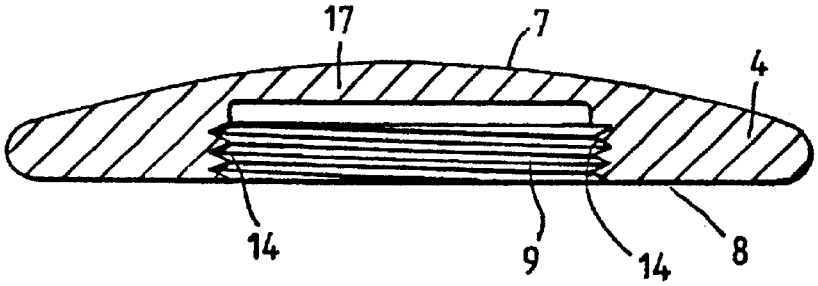
FIGS. 6 to 8 show cross sectional views of the components of a castor.
Figure 7:
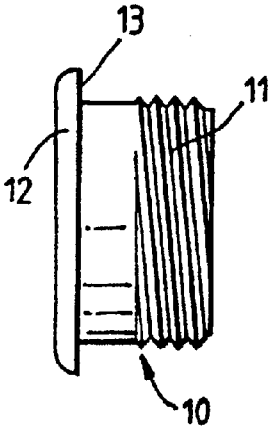
Figure 8:
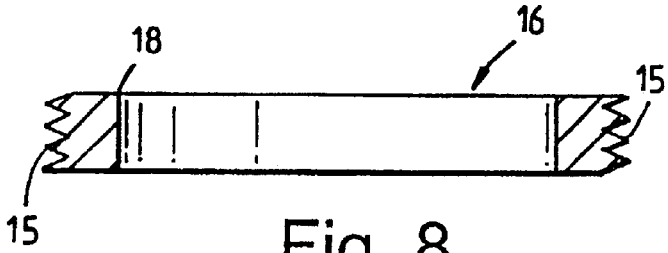

Referring now to FIGS. 6 to 8, the disc 4 has a top side 7 which is convex shaped and an under side 8 which is substantially planar. A recess 9 is located within the disc 4. The recess 9 has a substantially circular cross section and is adapted to receive the axle 10. Axle 10 comprises a body 11 of circular cross section and a circular portion of 12 of greater diameter than the diameter of the body 11 thereby forming flange 13.

Disc 4 has threaded portions 14 adapted to engage with the threaded portions 15 of the locating ring 16. Following insertion of the axle 10 into the recess 9 of disc 4 such that portion 12 abuts surface 17, the locating ring is passed over the body 11 and screwed into place by engagement of threaded portions 14 with threaded portions 15. The internal diameter of the locating ring 16 is such that its upper surface 18 abuts against flange 13 of the axle 10 thereby fixing disc 4 to axle 10. The arrangement allows the disc 4 to freely rotate relative to axle 10.

Figure 5:
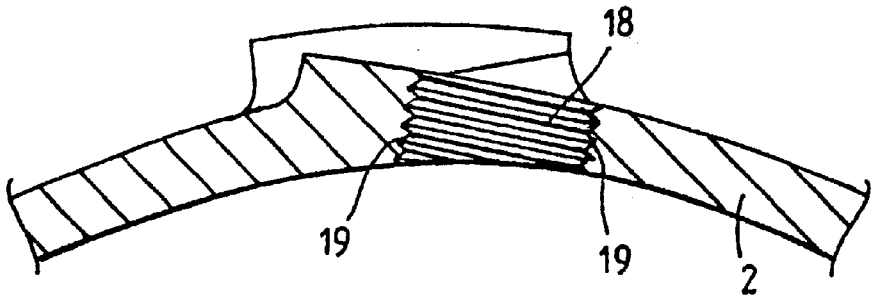
FIG. 5 is the cross sectional view of FIG. 3 with the castors not shown.

Referring to FIG. 5, an aperture 18 is shown located in the body 2. The aperture 18 has dimensions suitable for receiving the axle 10 of a castor 3 by engagement of the threaded portion of body 11 with threaded portions 19. Thus, the castor 3 is held fixed to body 2 at one end of the axle 10 whereas the disc 4 is freely rotatable about the other end of the axle 10. The ends of the axles 10 fixed to body 2 are shown located n apertures 18 in FIG. 1.

Figure 3:
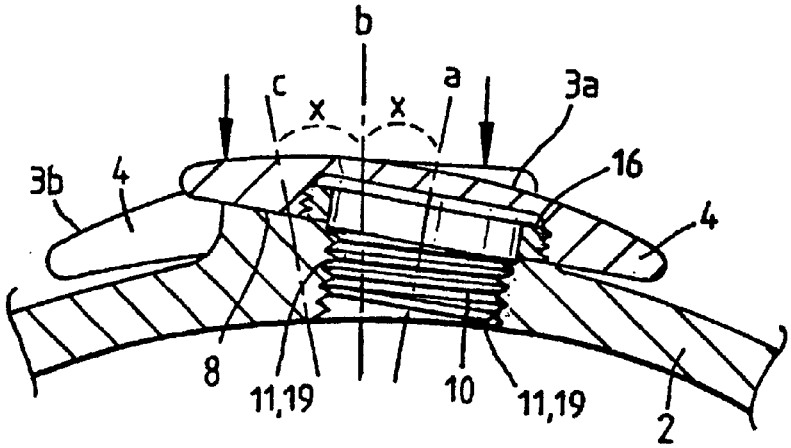
FIG. 3 is an expanded view of the cross sectional portion of FIG. 2.

As can be seen from FIG. 3, the axis of rotation (a) of the axle 10 of the castor 3*a* is offset relative to axis (b) running through the centre of the body 2, by an angle (x). Similarly, the castor 3*b,* located behind castor 3*a,* has an axis of rotation (c) which is offset relative to axis (b) by an angle (x) but in a direction opposite to that of castor 3*a*.

The angle (x) is predetermined so that the regions indicated by the heavy arrows protrude sufficiently from the periphery of the body 2 to allow engagement with the bore wall. It will be appreciated that the angle (x) will depend on the annular space between the casing pipe and the wall of the bore.

Contact of the bore wall and the castors 3*a* and 3*b* in the regions indicated by the heavy arrows will cause the discs 4 to rotate counter to each other. The aspect of counter rotation of the discs 4 is important to avoid spiralling of the tool as would be the tendency where an arrangement of castors allowed only for rotation of all castors in one direction.

Figure 4:
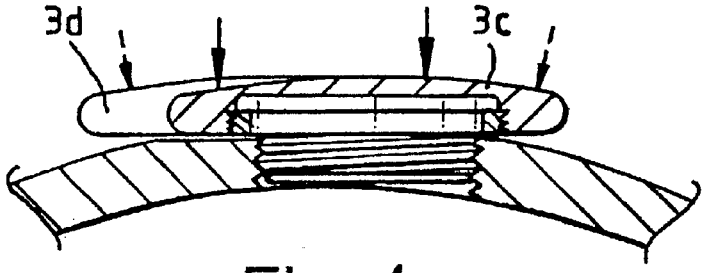
FIG. 4 is a view of a cross sectional portion of an alternative embodiment to the embodiment shown in FIG. 3.

In contrast to FIG. 3, FIG. 4 shows castors 3*c* and 3*d* supported by axles having parallel axes of rotation. The arrangement in FIG. 4 corresponds with the arrangement in FIG. 3 where the angle (x) is 0°. In this arrangement, the surface regions indicated by the dotted arrows will contact the internal wall of the bore rather than the regions indicated by the heavy arrows.

Figure 9:
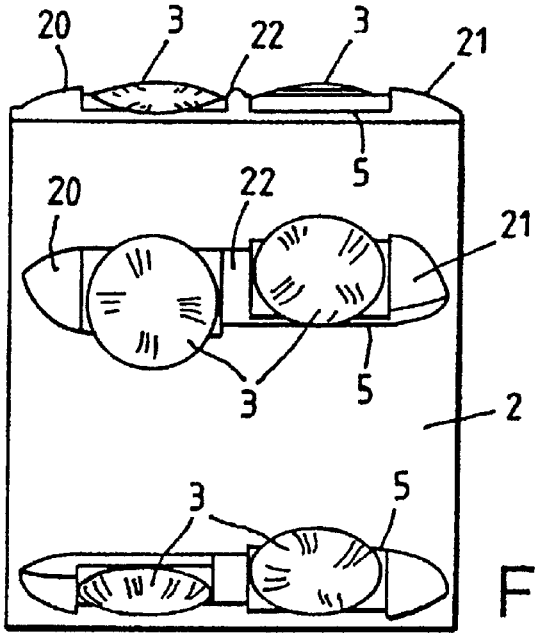
FIG. 9 is a side view of the tool shown in FIG. 1.

Referring now to FIG. 9, the castors 3 of each pair are shown offset relative to each other. The castor housings 5 have end leads 20 and 21 and central lead 22. The leads 20 to 22 have angled surfaces to minimise the impact on the castors 3 of any rock or other similar material as the tool 1 moves through the bore.

Figure 10:
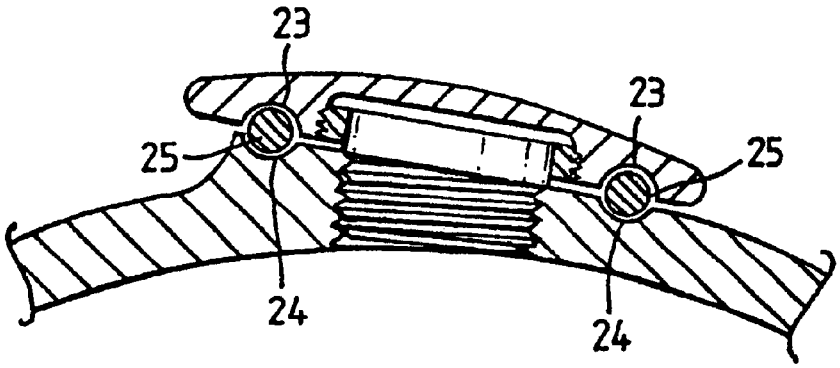
FIG. 10 is a cross sectional view of an alternative embodiment to the embodiment shown in FIG. 3.

The under side 8 of disc 4 shown in FIG. 3 abuts against the surface of body 2. In order to minimise friction between those surfaces, a washer made from a material such as PTFE, may be included. Alternatively, the respective surfaces may include grooves 23 and 24 as shown in FIG. 10. A ball race formed from grooves 23 and 24 and balls 25 can then be used to reduce friction between under side 8 of disc 4 and the outer surface of body 2.

Figure 11:
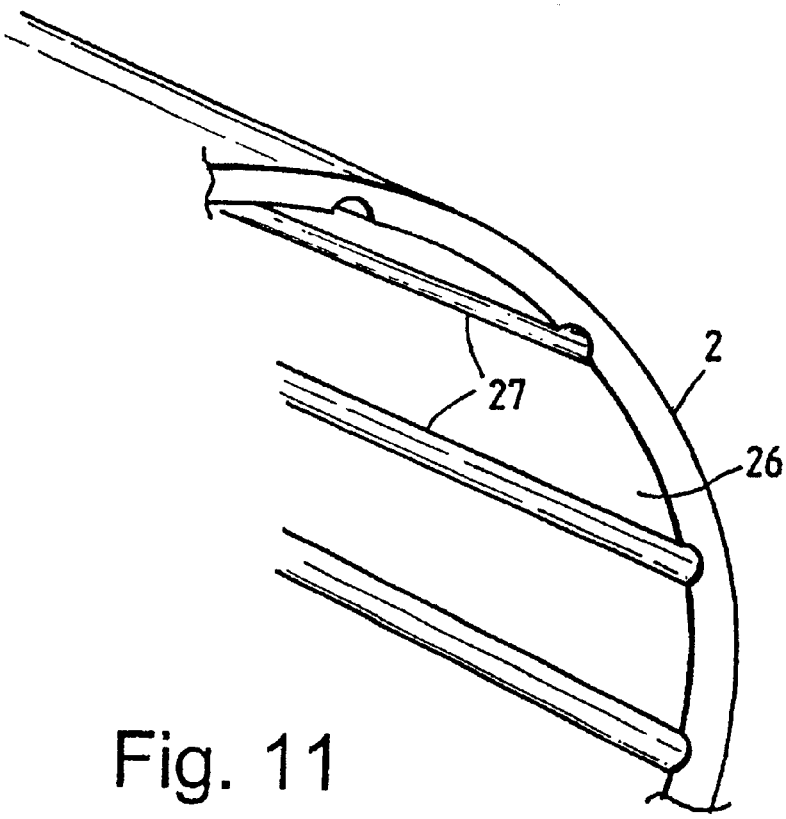
FIG. 11 is a partial perspective view of a friction reducing tool.

Lubrication between the internal surface 26 of body 2 and the casing pipe to which the tool 1 is fitted is enhanced with grooves 27 as shown in FIG. 11. The grooves 27 allow the flow of hydrodynamic fluid between the tool 1 and the casing pipe. Rotational friction is thereby minimised.

The term "castor" as used herein is intended to mean any friction reducing element which operates in a functionally equivalent manner to the castors described herein.

Where in the foregoing description reference has been made to integers or components having known equivalence then such equivalence are herein incorporated as if individually set forth.

Although this invention has been described by way of example it is to be appreciated that improvements and/or modifications may be made thereto without departing from the scope of the invention.

What is claimed is:

1. A friction reducing tool having:

a generally tubular body; and at least one castor provided about a periphery of the body, wherein the at least one castor comprises an axle having a first end mounted on the tubular body, and wherein the at least one castor is configured to rotate about a second end of the axle extending substantially radially outward from the periphery of the tubular body.

2. A friction reducing tool as claimed in claim 1, wherein the at least one castor is offset relative to at least one other castor by an amount sufficient to enable contact of each castor with the inside wall of a bore of a well when in use.

3. A friction reducing tool as claimed in claim 1, wherein the at least one castor and the at least one other castor are positioned on the tubular body so that the axis of rotation of one castor is parallel to the axis of rotation of the other castor, and the two castors are diametrically offset relative to an axis parallel to the axis of the tubular body.

4. A friction reducing tool as claimed in claim 3, wherein the at least one castor and the at least one other castor are offset by 3 to 30 mm.

5. A friction reducing tool as claimed in claim 1, wherein the at least one castor and the at least one other castor are positioned on the tubular body so that the axis of rotation of one castor and the axis of rotation of the other castor are angled away from each other.

6. A friction reducing tool as claimed in claim 5, wherein the axis of rotation of the at least one castor is offset from the axis of rotation of the at least one other castor by at least 50°.

7. A friction reducing tool as claimed in claim 5, wherein the axis of rotation of the castor is offset from the axis of rotation of the other castor by 10° to 20°.

8. A friction reducing tool as claimed in claim 1, wherein each castor includes a rotatable disc and an axle.

9. A friction reducing tool as claimed in claim 8, wherein the outer surface of the rotatable disc is convex.

10. A friction reducing tool as claimed in claim 9, wherein the tubular body contains an aperture for receiving an axle of the castor.

11. A friction reducing tool as claimed in claim 1, wherein each castor is disposed into one or more groups, wherein each group is located substantially equidistant about the periphery of the tubular body.

12. A friction reducing tool as claimed in claim 11, wherein each group of castors comprises one or more pairs of complementary castors offset to each other.

13. A friction reducing tool as claimed in claim 12, wherein each group of castors comprises a single pair of castors.

14. A friction reducing tool as claimed in claim 1, wherein the one or more groups comprise five groups of castors.

15. A friction reducing tool as claimed in claim 1, wherein the tool is fixed to a tubular section of a casing stand or drill string.

16. The tool of claim 1, wherein the at least one castor is disposed in an offset position relative to at least another castor provided about the periphery of the tubular body.

17. A friction reducing tool having:

a generally tubular body;

at least one castor provided about a periphery of the body, wherein the at least one castor comprises an axle having a first end mounted on the tubular body, and wherein the at least one castor includes a rotatable disc; and wherein the tubular body contains an aperture for receiving the axle, wherein the axle is fixed to the tubular body within the aperture, and the rotatable disc is free to rotate about the second end of the axle protruding from the tubular body.

18. A method of using a friction reducing tool comprising:

fitting a friction reducing tool to a pipe, wherein the friction reducing tool comprises:

a generally tubular body; and at least one castor provided about a periphery of the body, wherein the at least one castor comprises an axle having a first end mounted on the tubular body, and wherein the at least one castor is configured to rotate about a second end of the axle extending substantially radially outward from the periphery of the tubular body; and running the pipe through the bore of a well.

* * * * *